US007249554B2

(12) United States Patent
Loedige et al.

(10) Patent No.: US 7,249,554 B2
(45) Date of Patent: Jul. 31, 2007

(54) HYDRAULIC CONTROL ARRANGEMENT

(75) Inventors: Heinrich Loedige, Vaihingen (DE); Christoph Keyl, Korntal-Muenchingen (DE)

(73) Assignee: Bosch Rexroth AG, Stuttgart (DE)

( * ) Notice: Subject to any disclaimer, the term of this patent is extended or adjusted under 35 U.S.C. 154(b) by 0 days.

(21) Appl. No.: 10/556,899

(22) PCT Filed: May 10, 2004

(86) PCT No.: PCT/DE2004/000969

§ 371 (c)(1),
(2), (4) Date: Dec. 21, 2005

(87) PCT Pub. No.: WO2004/104426

PCT Pub. Date: Dec. 2, 2004

(65) Prior Publication Data

US 2006/0162544 A1 Jul. 27, 2006

(30) Foreign Application Priority Data

May 15, 2003 (DE) ..... 103 21 914

(51) Int. Cl.
*F15B 13/08* (2006.01)

(52) U.S. Cl. ..... 91/445; 91/446

(58) Field of Classification Search ..... 60/422; 91/433, 444, 445, 446, 448
See application file for complete search history.

(56) References Cited

U.S. PATENT DOCUMENTS

| | | | | |
|---|---|---|---|---|
| 5,083,430 | A | 1/1992 | Hirata et al. | |
| 5,351,601 | A | 10/1994 | Zeuner et al. | |
| 5,660,096 | A | 8/1997 | Friedrichsen | |
| 6,098,647 | A * | 8/2000 | Haussler et al. | 91/445 |

FOREIGN PATENT DOCUMENTS

| | | |
|---|---|---|
| DE | 198 02 430 A1 | 7/1999 |
| DE | 43 07 872 C2 | 5/2001 |
| DE | 199 31 142 C2 | 7/2002 |
| DE | 100 45 404 C2 | 10/2002 |
| DE | 102 11 299 A1 | 10/2003 |

* cited by examiner

*Primary Examiner*—Michael Leslie
(74) *Attorney, Agent, or Firm*—Oliff & Berridge, PLC

(57) ABSTRACT

What is disclosed is a hydraulic control arrangement for controlling a consumer, comprising a continuously adjustable directional control valve, an individual pressure compensator associated to the latter, as well as shut-off blocks arranged downstream from the directional control valve. In accordance with the invention, in the case of a insufficient supply of the consumer the pressure compensator is subjected not to the pressure in the supply (load pressure) but to a higher pressure, so that the control pressure difference at the supply control edge is raised.

10 Claims, 3 Drawing Sheets

HYDRAULIC CONTROL ARRANGEMENT

The invention relates to a hydraulic control arrangement for controlling a consumer in accordance with the preamble of claim 1.

From DE 100 45 404 C2 an LS control arrangement is known wherein a hydraulic consumer, for instance a double-acting cylinder for moving a load, may be supplied with pressure medium via a continuously adjustable directional control valve. In the pressure medium supply to the cylinder and in the drain from the cylinder respective shut-off valves are provided, wherein the shut-off valve on the supply side is taken into an open position by the pressure downstream from the directional control valve. By actuation of a topping piston, the shut-off valve on the drain side may be taken into an open position that allows the pressure medium to drain from the consumer towards the directional control valve.

In the known solution, a drain control is effected by means of the drain-side shut-off block by feeding back the drain pressure downstream from the spool control edge of the continuously adjustable directional control valve determining the drain to the topping piston of the shut-off block.

It is a problem in this solution that, for instance in the case of a "pulling load", the pressure in the supply may drop below the pressure in the drain, whereby the risk of an insufficient supply of the supply-side cylinder chamber may occur in the supply. Such insufficient supply may lead to cavitations whereby the consumer or the hydraulic switching elements associated to it may be damaged.

Such an operating condition may occur, e.g., when a load is initially raised, then overcomes a dead point, and subsequently exerts a pulling effect on the hydraulic consumer.

From DE 199 31 142 C2 a control arrangement having a similar construction is known wherein, however, the drain control by means of the shut-off block is not effected but a supply control through an individual pressure compensator arranged upstream of the directional control valve is performed. The latter is acted on by the force of a spring in the opening direction and by the pressure in the supply towards the consumer. In this solution the above described problems may moreover occur in the case of a pulling load, and furthermore the draining volume flow of pressure medium should also be controlled independent of load pressure.

In principle, several methods for avoiding insufficient supply are known. Thus it is possible, e.g., to provide anti-cavitation valves whereby pressure medium may be sucked in from the tank in the case of an insufficient supply. Owing to the low differential pressure between cylinder suction side and tank pressure, however, such anti-cavitation valves need to have a very large cross-section.

Another possibility is the use of biasing valves in the pressure medium drain. This does, however, imply the problem that the supply pressure, particularly at small loads, must be raised very high, which results in high energy losses.

As an alternative it is also possible to use countertorque lowering valves which do, however, also require a high pressure on the supply side in order to control the volume flow on the drain side.

The invention is based on the object of furnishing a hydraulic control arrangement for controlling a consumer, in particular a double-acting consumer, wherein the risk of insufficient supply is minimized.

This object is attained through a control arrangement having the features of claim 1.

In accordance with the invention, the control arrangement comprises a continuously adjustable directional control valve to which an individual pressure compensator is associated. The latter is subjected in the opening direction to the force of a spring and a control pressure, and in the closing direction to a pressure in the supply upstream from the directional control valve. In the normal operating condition of the control arrangement, such as during lifting a load, the control pressure corresponds to the pressure in the supply downstream from the directional control valve, i.e., to the load pressure, and thus corresponds to a conventional LS control.

If there is a risk of an insufficient supply, i.e., when the pressure in the supply drops and in the presence of a pressure load in the drain (for instance in the case of a pulling load), the control pressure is raised so as to be higher than the pressure in the supply downstream from the directional control valve. Owing to this increase of the control pressure acting in the opening direction, the control pressure difference at the supply-side control edge of the directional control valve is increased, so that a higher pressure medium volume flow is conveyed to the supply-side cylinder chamber, and an insufficient supply may be prevented.

In accordance with the invention it is preferred if this control pressure is held at a constant, elevated level in the case of insufficient supply. This elevated control pressure may, for instance, be tapped in the pressure medium flow path between the shut-off block on the drain side and a drain control edge of the directional control valve.

As an alternative the control pressure may also be tapped from any other available constant pressure source.

In a preferred practical example, the shut-off block includes a topping piston which may be subjected to a release control pressure for releasing. In this variant it becomes possible to use the release control pressure adjusted, e.g., by means of a pressure reducing valve, as a control pressure.

Here it is preferred to subject the topping piston to the drain-side pressure, so that it will be subjected to the release control pressure in the topping direction, and to the pressure in the drain in the opposite direction, whereby a substantially load-independent drain control is made possible.

In a particularly preferred practical example, the supply-side and drain-side pressures are tapped downstream from the directional control valve and upstream from the respective shut-off valve, and the respective higher pressure is conducted via a shuttle valve to the spring chamber of the individual pressure compensator.

In an alternative solution, these two pressures may moreover be compared to the release control pressure, and the highest one of these pressures may be conducted via a shuttle valve assembly to the control surface of the individual pressure compensator acting in the opening direction.

In another advantageous practical example of the invention, the topping piston of the shut-off block is acted on by a spring in the raising direction. In this case a pressure spring whereby a pilot cone guided in the shut-off piston is biased into its closing position may be made to be weaker.

The shut-off valve may be designed with or without a seat difference.

Further advantageous developments of the invention are subject matter of further subclaims.

In the following two preferred practical examples of the invention are explained in more detail by referring to schematic drawings, wherein.

Figure 1:
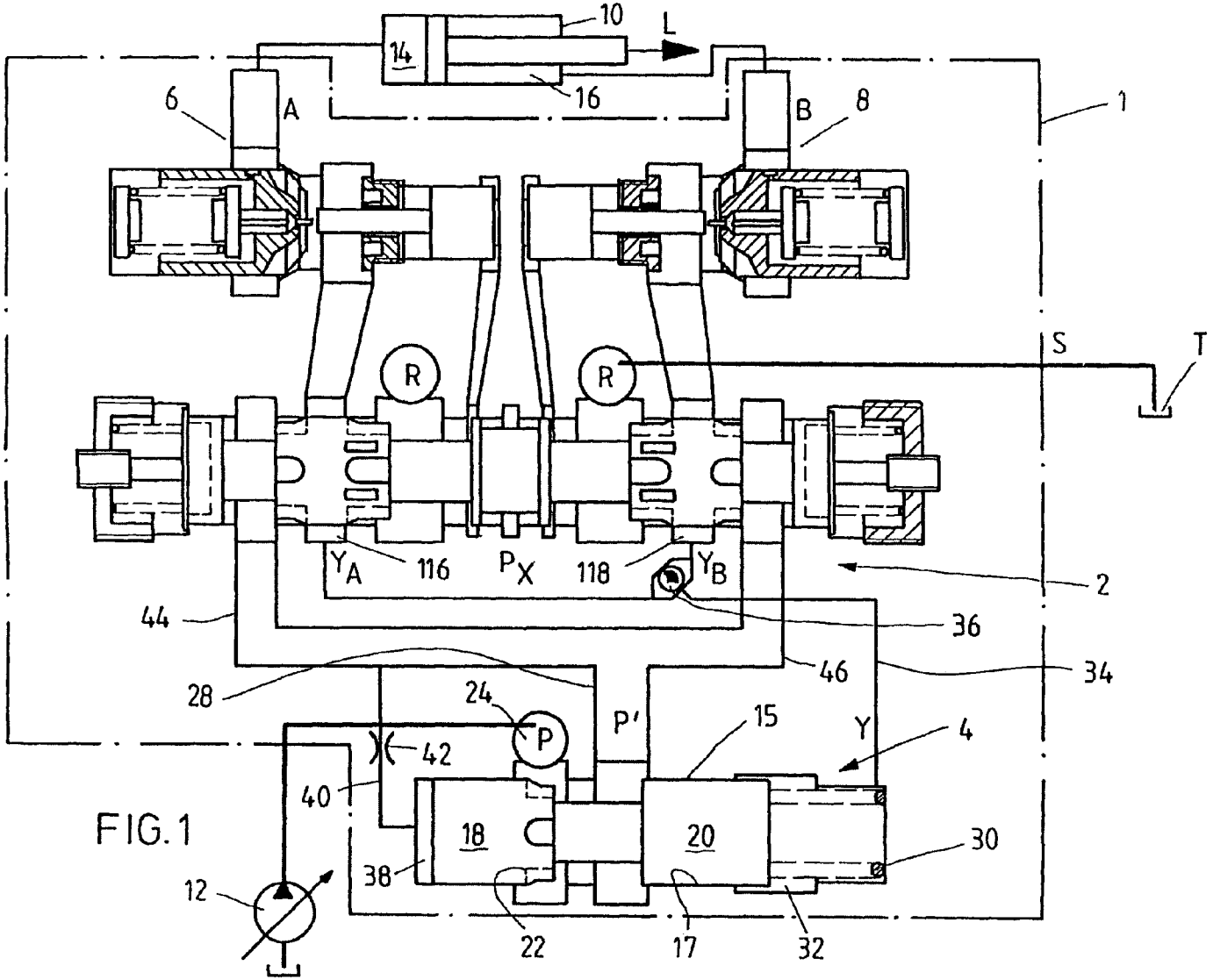
FIG. 1 is a circuit diagram of a practical example of an LS control arrangement.

FIG. 1 shows a valve disc 1 of a mobile control block whereby a consumer of a mobile working machine may be supplied with pressure medium. The valve disc 1 accommodates an LS control arrangement including a continuously adjustable directional control valve 2, an individual pressure compensator 4, and two shut-off valves 6, 8 whereby pressure medium from a pump, e.g., a variable displacement pump 12, may be supplied to the consumer, e.g. a hydraulic cylinder 10, and whereby the pressure medium may be returned from the consumer 10 to a tank T.

A cylinder chamber 14 of the hydraulic cylinder 10 is connected to a working port A, and an annular chamber 16 to a working port B, the tank is connected to a tank port S, and the variable displacement pump 12 to a pressure port P (perpendicular to the plane of drawing in FIG. 1).

In accordance with FIG. 1 a pressure compensator piston 15 of the individual pressure compensator 4—hereinafter referred to as pressure compensator—is guided in an axially sliding manner in a pressure compensator bore 17 of the valve disc 1. The pressure compensator piston 15 has a central annular groove whereby it is subdivided into a control collar 18 and a rear-side spring collar 20. On the control collar 18 a multiplicity of control notches are provided to form a control edge 22 whereby the connection from a pressure chamber 24 connected to the pressure port P to an adjacent pressure passage 28 may be opened and closed. The pressure compensator piston 15 is biased by a control spring 30 supported on an end face of the pressure compensator bore 17 in a direction in which the connection between the pressure chamber 24 and the pressure passage 28 is opened. A spring chamber accommodating the control spring 30 is connected to a control passage 34 leading to the outlet of a shuttle valve 36. The left-hand end face of the pressure compensator bore 16 in the representation of FIG. 1 delimits with the adjacent end face of the control collar 18 a control chamber 38 that is subjected to the pressure in the pressure passage 28 via another control passage. In the another control passage 40 a damping throttle 42 for attenuating high-frequency vibrations is moreover provided. The pressure passage 28 branches in accordance with FIG. 1 into two passages 44, 46 leading to the directional control valve 2. Details of this directional control valve 2 and of the two shut-off blocks 6, 8 shall be explained by referring to FIG. 2.

The continuously adjustable directional control valve 2 includes a valve spool 48 received in an axially slidable manner in a valve bore 50 of the valve disc 1. The valve spool 48 is biased into its represented basic position by a centering spring arrangement 52, 53. From this basic position the valve spool 48 may be displaced mechanically, electrically or hydraulically into work positions that shall be discussed in more detail further below. In the represented practical example, actuation of the valve spool 48 is to take place with the aid of one or two proportional magnets (not shown).

The valve bore 50 is provided with several annular chambers. A central control pressure chamber 52 is connected to a control port X (not shown) whereby the control pressure chamber 52 may be subjected to a constant release control pressure. On either side of the control pressure chamber 52 two annular return chambers 54, 56 are provided which are connected to the return port T via the tank passages R (see FIG. 1). On either side of the return chambers 54, 56 two additional annular chambers are provided, wherein the left-hand annular chamber in the representation of FIG. 2 shall in the following be referred to as the supply chamber 58, and the right-hand one as the drain chamber 60. Adjacent the supply and drain chamber 58, 60, respectively, there are two pressure chambers 63, 65 that are connected to the passages 44 and 46, respectively. Between the central control pressure chamber 52 and the two return chambers 54, 56, two annular chambers 62,65 are furthermore provided in the valve bore 50.

Figure 2:
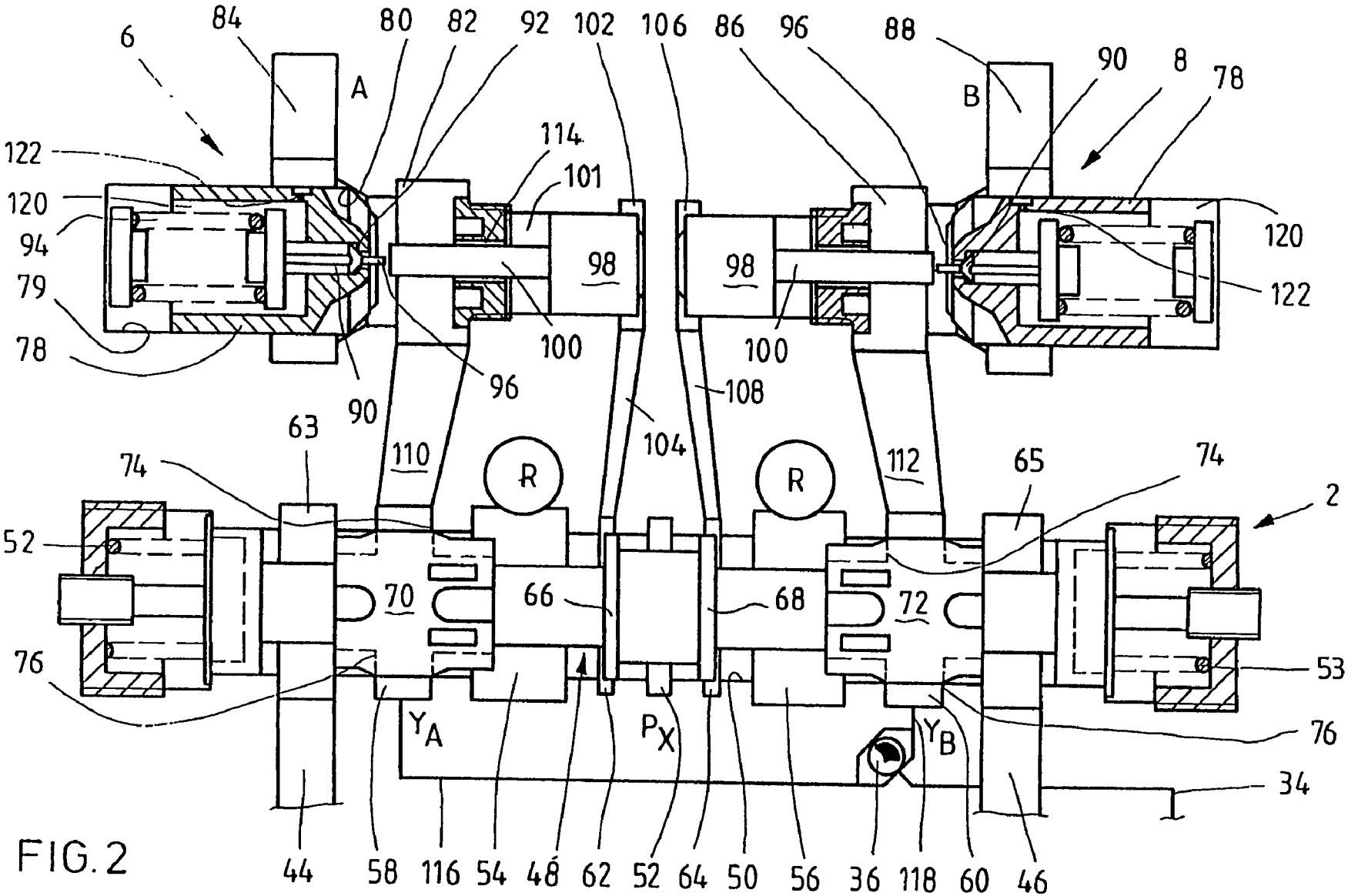
FIG. 2 is an enlarged representation of the control arrangement of FIG. 1.

The valve spool 50 has in the range of these annular chambers 62, 64 two narrow annular webs 66, 68 blocking the connection between the central control pressure chamber 52 and the two adjacent annular chambers 62, 64 in the basic position represented in FIG. 2.

On the valve spool 50 two control collars 70, 72 are moreover formed, the respective annular end faces of which are provided with control notches such that one drain control edge 74 and one supply control edge 76 are formed on each control collar 70, 72. The geometry of the control collars 70, 72 having the control notches formed on them is adapted such that in the represented basic position, the supply chamber 58 and the drain chamber 60 are opened towards the respective adjacent return chambers 54, 56, so that these pressure chambers are relieved of pressure. The connection between the supply chamber 58 and the drain chamber 60 to the external pressure chambers 63, 65 is closed by the supply control edge 74.

The two shut-off blocks 6, 8 shown in enlarged representation in FIG. 2 have an identical construction, so that only shut-off block 6 shall be described in the following. Each shut-off block 6, 8 includes a shut-off piston 78 that is biased against a valve seat 80. The shut-off piston 78 is guided in a bore 79 of the disc 1. In the represented shut-off position, the connection between a supply chamber 82 and a working chamber 84, or the connection between a drain chamber 86 and a working chamber 88, respectively, is blocked free of leakage. The shut-off piston 78 has the form of a hollow piston, with a pilot cone 90 being guided in its piston bottom having the form of a cone, and which pilot cone is biased by a pilot spring 94 against a pilot seat 92. By this pilot spring 94 the shut-off piston 78 is moreover biased against its valve seat 80. The pilot cone 90 includes a projection 96 axially protruding from the pilot seat 92 so as to project in the direction towards the supply chamber 82 or the drain chamber 86, respectively.

In the end portion of the bore 79 that is removed from the shut-off piston 78 there is moreover guided in an axially sliding manner a topping piston 98 having the form of a stepped piston, the piston rod 100 of which extends in the direction towards the projection 96 of the pilot cone 90. A release control chamber 102 connected via a connecting passage 104 with the annular chamber 62 opens into the end portion of the bore 79 receiving the topping piston 98. Correspondingly a release control chamber 106 of the shut-off block 8 is connected via another connecting passage 108 with the annular chamber 64.

The supply chamber 82 of the shut-off block 6 is connected via an intermediate passage 110 with the supply chamber 58, and correspondingly the drain chamber 86 of the shut-off block 8 is connected via another intermediate passage 112 with the drain chamber 60. The chamber 101 on the rod side of the piston 98 is connected with the chamber 82 via a throttle depending on the required attenuation.

In the practical example represented in FIG. 1, the supply chamber 58 and the drain chamber 60 are each connected via a control line 116 or 118, respectively, with the two inlets of the shuttle valve 36. In other words, via the shuttle valve the higher one of the two pressures YA, YB tapped in the supply chamber 58 and in the drain chamber 60 is reported into the control passage 34.

In order to describe the operation of this control arrangement it shall initially be assumed that the hydraulic cylinder 10 is subjected to a pulling load L. Accordingly pressure medium must be conveyed via the working port A into the cylinder chamber 14, and the pressure medium must drain from the annular chamber 16 of the hydraulic cylinder via the working port B.

To this end the valve spool 48 of the continuously adjustable directional control valve 2 is displaced to the right in the representation in accordance with FIG. 1, so that the connection between the annular chamber 62 and the supply chamber 58, as well as the connection between the drain chamber 60 and the return chamber 56 via the drain control edge 74 is opened by the supply control edge 76. The pressure medium may then flow from the variable displacement pump 12 via the pressure chamber 24, the opened pressure compensator 4—as shall be described further in the following—and the pressure passage 28 into the passage 44 and from there flow, via the cross-section of the directional control valve 4 opened by the supply control edge 76, into the intermediate passage 110 and from there into the supply chamber 82 of the shut-off block 6.

As soon as the pressure in the supply chamber 82 becomes higher than the pressure equivalent of the pilot spring 94 plus the load pressure at the working port A, the shut-off piston 78 is raised from its valve seat 80, so that the pressure medium may flow into the cylinder chamber 14.

The pressure compensator 4 is subjected to the pressure in the control passage 40 and thus to the pressure in the passage 44 in the closing direction, and to the force of the control spring 30 and to the pressure in the control passage 34 in the opening direction. At a sufficient supply of the consumer 10 with pressure medium, the pressure in the supply chamber 58 is higher than the pressure in the drain chamber 60, so that correspondingly the pressure downstream from the cross-section opened by the supply control edge 76 prevails in the spring chamber 32 of the individual pressure compensator 4. In other words, the effective cross-section of a supply metering orifice is determined by this supply control edge 76, with the pressure compensator piston 15 adjusting itself into its control position such that the pressure drop across this metering orifice is kept constant independent of load.

The control pressure PX prevailing in the control pressure chamber 52 is conducted via the annular chamber 64 and the connecting passage 108 into the release control chamber 106, so that the topping piston 98 of the shut-off block 8 is taken to the right in contact against the projection 96 of the pilot cone 90 in the representation in accordance with FIG. 2. The release control pressure is selected such as to be sufficient in order to raise the pilot cone 90 via the topping piston 98 from its pilot seat 92 against the force of the pilot spring 94 and against the load pressure acting on the seat surface. When the pilot control is opened, the spring chamber 120, which is connected via an orifice 122 with the working chamber 88 and thus subjected to the pressure at the working port B, is connected with the tank T via the pilot control including the drain chamber 86 and via the intermediate passage 112, the drain chamber 60, the drain cross-section of the directional control valves 2 opened via the drain control edge 74, the return chamber 56, and the return R, and is thus relieved of pressure in the closing direction. The pressure-compensated shut-off piston 78 may then be raised from its valve seat by the topping piston 98, so that the pressure medium may flow off towards the tank T along the above mentioned pressure medium flow path. The draining pressure medium volume flow is throttled at the drain control edge 74 of the valve spool 48, so that a pressure gradient is established between the drain chamber 60 and the return chamber 56. In the case of a pulling load, drain control is then practically effected through feeding back the pressure in the drain chamber 86, which acts on the end face of the piston rod 100 and the annular surface of the topping piston 98, so that the latter is subjected to the release control pressure in the release control chamber 106 on the one hand and to the pressure equivalent of the pilot spring 94 and the pressure acting on the piston rod 100 on the other hand. I.e., on the drain side a flow regulator is formed by the shut-off block 8 and the drain-side measuring orifice, wherein the control pressure difference results from the pressures acting on the topping piston, or from pressure equivalents, respectively. The pressure in the drain is thus controlled in the case of a pulling load by a constructionally determined constant pressure that is independent of the load pressure at port B and thus in the annular chamber 16. In other words, a load pressure-independent control is performed both on the supply side and on the drain side.

If, now, in the case of a pulling load the pressure on the supply side decreases, for instance owing to an insufficient control pressure difference at the supply control edge 76 in the presence of an insufficient supply of the cylinder chamber 14, so as to become smaller than the drain-side pressure, then the higher one of these pressures, i.e., the pressure in the drain chamber 60, is reported via the shuttle valve 36 into the control passage 34. This control pressure is—in accordance with the above description—substantially constant and prevails in the spring chamber 32 of the individual pressure compensator 4. By this elevated, constant pressure the control pressure difference at the supply control edge 76 of the directional control valve is increased in the supply to the cylinder chamber 14, and the pressure medium volume flow in the supply increases until a pressure medium volume flow equilibrium between supply and drain is established—an insufficient supply of the consumer may reliably be prevented by this increase of the control pressure difference. It is considered an essential aspect of the invention that in the event of a pressure drop in the supply under the pressure in the drain, the individual pressure compensator is subjected to a constant, higher pressure than in the supply so that the control pressure difference at the supply control edge is increased.

Upon demand this pressure prevailing in the control passage 34 might also be tapped from any constant pressure source whatsoever.

Figure 3:
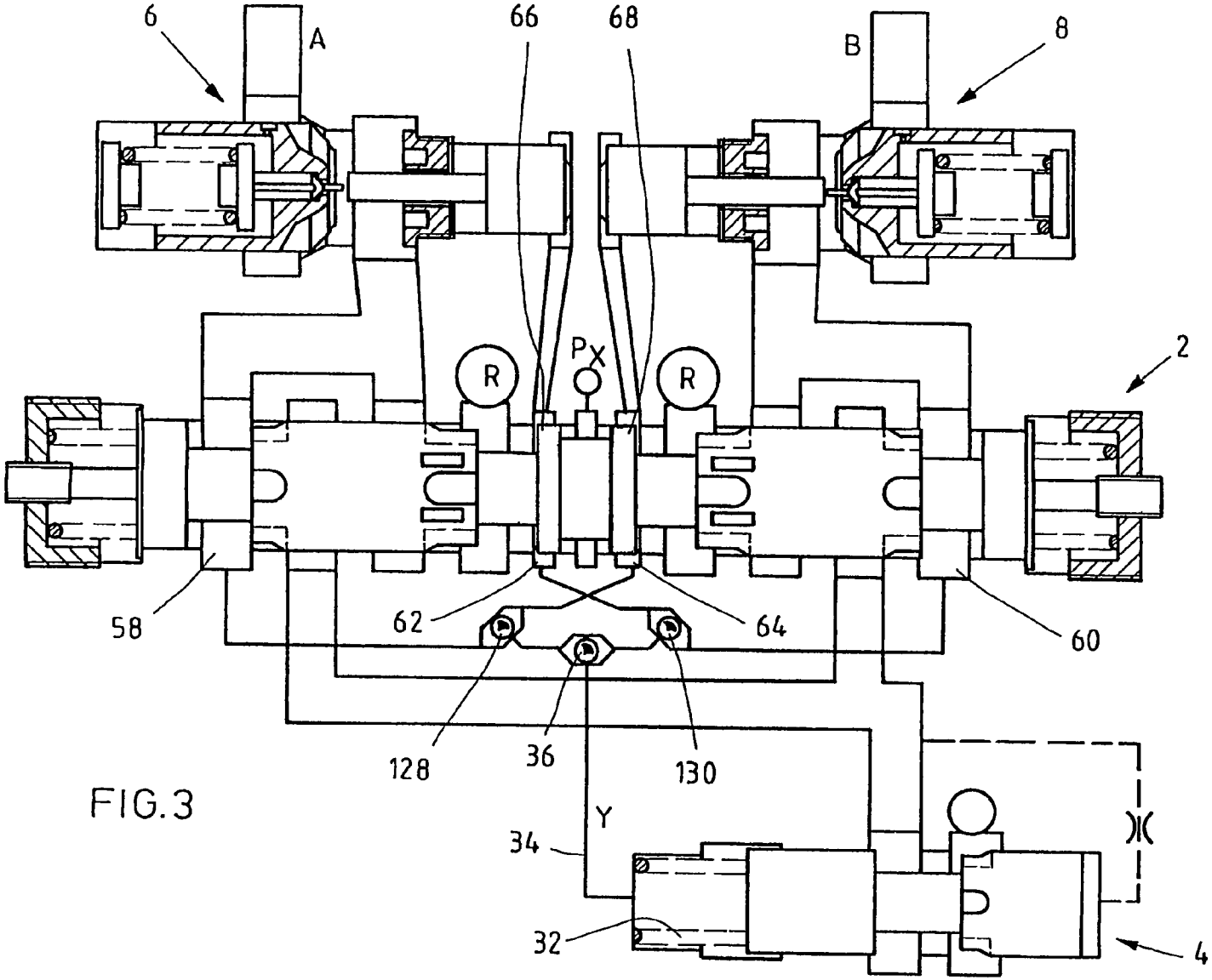
FIG. 3 shows another practical example of a control arrangement in accordance with the invention.

Such a form is realized in the practical example represented in FIG. 3. The basic construction of this practical example corresponds to the one of FIG. 2, so that only the essential differences shall presently be discussed. The control arrangement in accordance with FIG. 3 also includes a directional control valve 2, an individual pressure compensator 4, as well as two shut-off blocks 6, 8. The two annular webs 66, 68 arranged on either side of the control pressure chamber 52 are formed such that the two annular chambers 62, 64 are connected with the two return chambers 54,56 in the basic position of the continuously adjustable directional control valve 2, so that the rear sides of the two topping pistons 98 are relieved of pressure.

Furthermore the control arrangement in accordance with FIG. 3 has a second shuttle valve 128 whereby the pressure in the supply chamber 58 is compared to the pressure in the annular chamber 64, whereas the pressure in the drain chamber 60 is compared to the pressure in the annular chamber 62 through the intermediary of a third shuttle valve 130. The outlets of the two shuttle valves 128, 130 are connected to the inlets of the shuttle valve 36, the outlet of which is connected with the spring chamber 32 of the individual pressure compensator 4 via the control passage 34.

In other words, in this embodiment the highest one of the pressures in the supply chamber 58, in the drain chamber 60, or the release control pressure prevailing in the annular chambers 62, 64 is reported to the spring chamber 32, and this constant pressure is used for raising the control pressure difference at the supply control edge 76 so as to avoid an insufficient supply.

Thanks to the construction in accordance with the invention there is no more necessity to provide anti-cavitation valves or the like. Inasmuch as an insufficient supply of the consumer is virtually excluded, it is also possible to avoid cavitation phenomena at the control edges of the directional control valve 2. Moreover discharges of air on the suction side of the cylinder are avoided. Another advantage may be seen in the fact that the increase of the supply pressure is substantially smaller in comparison with the solutions including biasing valves in the drain as described at the outset, or in the case of a countertorque lowering valve. In the represented practical example the shut-off piston 78 is designed to have on the rear side the same diameter as the valve seat 80. It would, however, also be possible to utilize a shut-off block having a seat difference.

What is disclosed is a hydraulic control arrangement for controlling a consumer, comprising a continuously adjustable directional control valve, an individual pressure compensator associated to the latter, as well as shut-off blocks arranged downstream from the directional control valve. In accordance with the invention, in the case of a insufficient supply of the consumer the pressure compensator is subjected not to the pressure in the supply (load pressure) but to a higher pressure, so that the control pressure difference at the supply control edge is raised.

LIST OF REFERENCE SYMBOLS

1 valve disc
2 directional control valve
4 individual pressure compensator
6 shut-off block
8 shut-off block
10 hydraulic cylinder
12 pump
14 cylinder chamber
15 pressure compensator piston
16 annular chamber
17 pressure compensator bore
18 control collar
20 spring collar
22 control edge
24 pressure chamber
28 pressure passage
30 control spring
32 spring chamber
34 control passage
36 shuttle valve
38 control chamber
40 another control passage
42 damping throttle
44 passage
46 passage
48 valve spool
50 valve bore
52 control pressure chamber
54 return chamber
56 return chamber
58 supply chamber
60 drain chamber
62 annular chamber
63 pressure chamber
64 annular chamber
65 pressure chamber
66 annular web
68 annular web
70 control collar
72 control collar
74 drain control edge
76 supply control edge
78 shut-off piston
79 bore
80 valve seat
82 supply chamber
84 working chamber
86 drain chamber
88 working chamber
90 pilot cone
92 pilot seat
94 pilot spring
96 projection
98 topping piston
100 piston rod
101 annular chamber am topping piston
102 release control chamber
104 connecting passage
106 release control chamber
108 connecting passage
110 intermediate passage
112 intermediate passage
114 slide-type guide
116 control line
118 control line
120 spring chamber
122 orifice
128 2nd shuttle valve
130 3rd shuttle valve

The invention claimed is:

1. A hydraulic control arrangement for controlling a consumer, comprising a continuously adjustable directional control valve whereby two work ports connected to the consumer may be connected to a pressure or supply port or to a drain port, wherein a releasable shut-off block is provided in at least one working line acting as a drain line, and comprising an individual pressure compensator associated to the continuously adjustable directional control valve and adapted to be subjected to the force of a spring and to a control pressure in the opening direction and to a pressure upstream from the directional control valve in the closing direction, characterized in that the control pressure is determined by a comparison arrangement for comparison of the effective load pressure in the supply with a constant pressure, wherein the individual pressure compensator is subjected to the constant pressure if the constant pressure is higher than the effective load pressure in the supply.

2. The hydraulic control arrangement in accordance with claim 1, wherein the higher control pressure is constant.

3. The hydraulic control arrangement in accordance with claim 1, wherein the control pressure in a pressure medium flow path is tapped between the shut-off block on the drain side and a drain control edge of the directional control valve.

4. The hydraulic control arrangement in accordance with claim 2, wherein the control pressure is tapped from a constant pressure source.

5. The hydraulic control arrangement in accordance with claim 1, wherein the shut-off block includes a topping piston adapted to be subjected to a release control pressure for releasing, and wherein the control pressure corresponds to the release control pressure.

6. The hydraulic control arrangement comprising a shut-off block in accordance with claim 5, wherein the topping piston is subjected to the load pressure on the drain side in the closing direction of the shut-off block.

7. The hydraulic control arrangement in accordance with claim 6, wherein the highest of the following pressures: release control pressure, pressure downstream from a supply metering orifice of the directional control valves, and pressure downstream from a drain measuring orifice, is tapped via a shuttle valve assembly as a control pressure.

8. The hydraulic control arrangement in accordance with claim 1, wherein one respective shut-off block is associated to the pressure medium supply and to the pressure medium drain, and the higher one of the pressures between the shut-off blocks and the directional control valve is tapped via a shuttle valve as a control pressure.

9. The hydraulic control arrangement in accordance with claim 1, wherein the shut-off block includes a shut-off piston biased against a valve seat which in turn is provided with a pilot seat against which a pilot cone is biased by means of a pilot spring, wherein the pilot cone is adapted to be raised from the pilot seat by means of a topping piston, and the topping piston is biased in a direction away from the shut-off piston.

10. The hydraulic control arrangement in accordance with claim 1, wherein the shut-off block is designed without a seat difference.

* * * * *